US005904375A

United States Patent [19]

Brugada

[11] Patent Number: 5,904,375

[45] **Date of Patent: *May 18, 1999**

[54] SECURITY SUPPORT WITH AN IMPRINTED MICROPATTERN CONTAINED THEREIN WHICH PREVENTS FALSIFICATION OF DOCUMENTS WHEN HIGH-RESOLUTION COPIER MACHINES ARE USED

[76] Inventor: Jorge C.B. Brugada, San Antonio 155 c/gral. Santos, Asuncion, Paraguay

[ * ] Notice: This patent issued on a continued prosecution application filed under 37 CFR 1.53(d), and is subject to the twenty year patent term provisions of 35 U.S.C. 154(a)(2).

[21] Appl. No.: 08/689,084

[22] Filed: Jul. 30, 1996

[30] Foreign Application Priority Data

Aug. 1, 1995 [CL] Chile ..... 1153-95

[51] Int. Cl.[6] ..... B42D 15/00

[52] U.S. Cl. ..... 283/85; 283/57; 283/93; 283/95; 283/96; 283/901; 283/902

[58] Field of Search ..... 283/85, 93, 95, 283/96, 114, 57, 58, 59, 902, 901, 900

[56] References Cited

U.S. PATENT DOCUMENTS

| | | | |
|---|---|---|---|
| 3,088,841 | 5/1963 | Guertin | 283/95 X |
| 5,078,428 | 1/1992 | Maeno | 283/93 |
| 5,149,140 | 9/1992 | Mowry, Jr. et al. | 283/93 |
| 5,171,040 | 12/1992 | Orndorff | 283/58 X |
| 5,197,765 | 3/1993 | Mowry, Jr. et al. | 283/902 X |
| 5,297,815 | 3/1994 | Anderson et al. | 283/93 |
| 5,340,159 | 8/1994 | Mowry, Jr. | 283/93 |
| 5,368,334 | 11/1994 | Christy et al. | 283/114 X |
| 5,374,976 | 12/1994 | Spannenburg | 283/901 X |
| 5,375,886 | 12/1994 | Tsuchiya | 283/93 |
| 5,429,392 | 7/1995 | Loving | 283/93 X |

*Primary Examiner*—Daniel W. Howell
*Assistant Examiner*—Adesh Bhargava

[57] ABSTRACT

A support of paper or the like is imprinted with a security micropattern which prevents falsification of documents printed on the support by use of high resolution copier machines. The security micropattern is printed with ink which is transparent or of the same coloration as the support. The ink comprising the micropattern is either non-absorbent or hydrophilic, and the ink used for inscribing on the support is either hydrophilic or non-absorbent, respectively.

20 Claims, 2 Drawing Sheets

SECURITY SUPPORT WITH AN IMPRINTED MICROPATTERN CONTAINED THEREIN WHICH PREVENTS FALSIFICATION OF DOCUMENTS WHEN HIGH-RESOLUTION COPIER MACHINES ARE USED

SPECIFICATION

The present invention relates to a security support that includes a security micropattern imprinted onto paper or a similar support, which prevents the falsification of documents when high-resolution copier machines are used.

The development of digital high-resolution color copier machines has made possible to reproduce documents with great accuracy making them practically undistinguishable from the originals. To prevent falsification of documents using these copying methods, a variety of security techniques have been developed.

One group of security techniques consists of mixing a certain type of special fibers into the paper pulp, presence of which can be determined with special detecting apparatus. These fibers, for example, could be made of a fluorescent material which, when illuminated by an ultraviolet light source, appears more brilliant. This type of solutions have the disadvantage that the security is broken if virgin paper sheets containing this type of special fibers are obtained and fed into a high-resolution digital photocopier for reproduction of the document that is being counterfeited.

Another group of solutions that aim to prevent the falsification of documents consists of imprinting patterns of microtext or microlines onto the paper which is the base for the document wherein, when the document is reproduced by means of high-resolution digital apparatus, the patterns of microtext or microlines are outside of the resolution range of the copying means. Just as with the first group of techniques, it is easy to break the security if sheets impressed with this type of micropatterns are obtained and fed into a high-resolution digital photocopying machine for reproduction of the document that is being counterfeited.

With present invention, on the contrary, even though it is based on the use of microtext or microlines, the virgin paper that contains these patterns cannot be fed successfully into a high-resolution digital copier machine with the intent to photocopy and falsify an original document that employs the security support of the invention. Furthermore, with the aid of a lens with an enlarging capability of 8× to 10×, it is easy to determine if the document is an original or a falsification.

The invention will be described further by means of figures that illustrate an example of a preferred form, but which do not restrict the protection only to this example.

Figure 1:
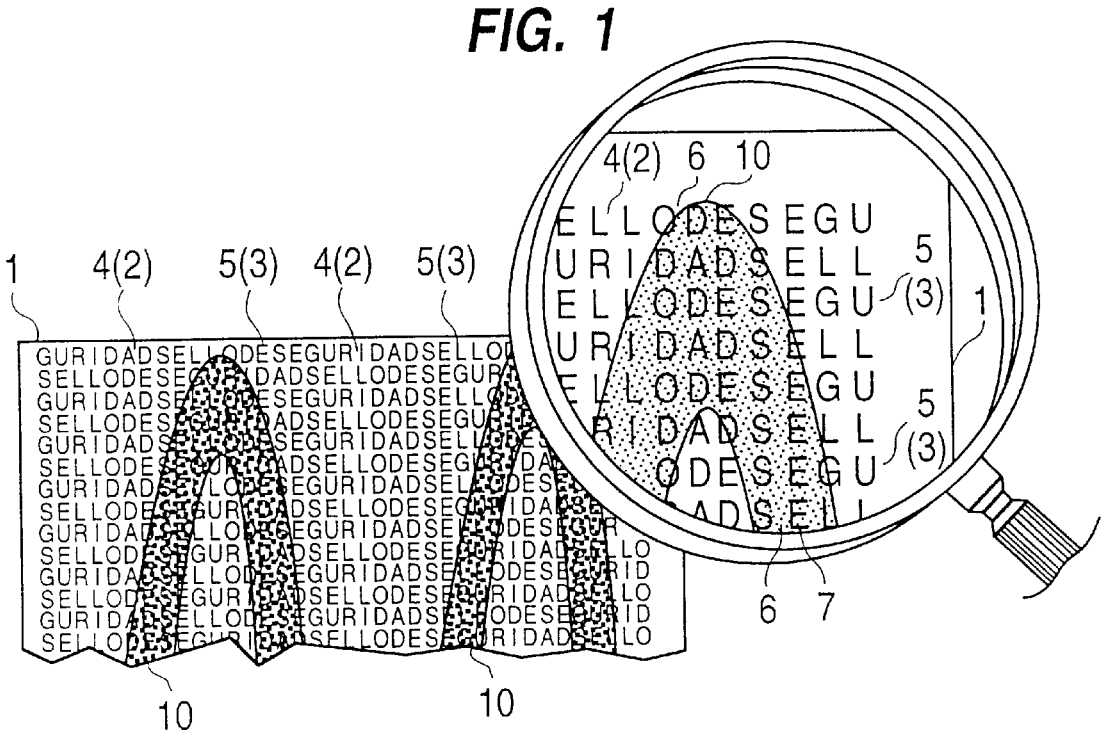
FIG. 1 shows a diagram of a paper support with micropatterns according to the invention and with a part of text of the original document showing enlarged in the upper right corner. In this figure, for purpose of clarity, the pattern is shown as visible and in an enlargement proportion that is much larger than in reality.
Figure 3:
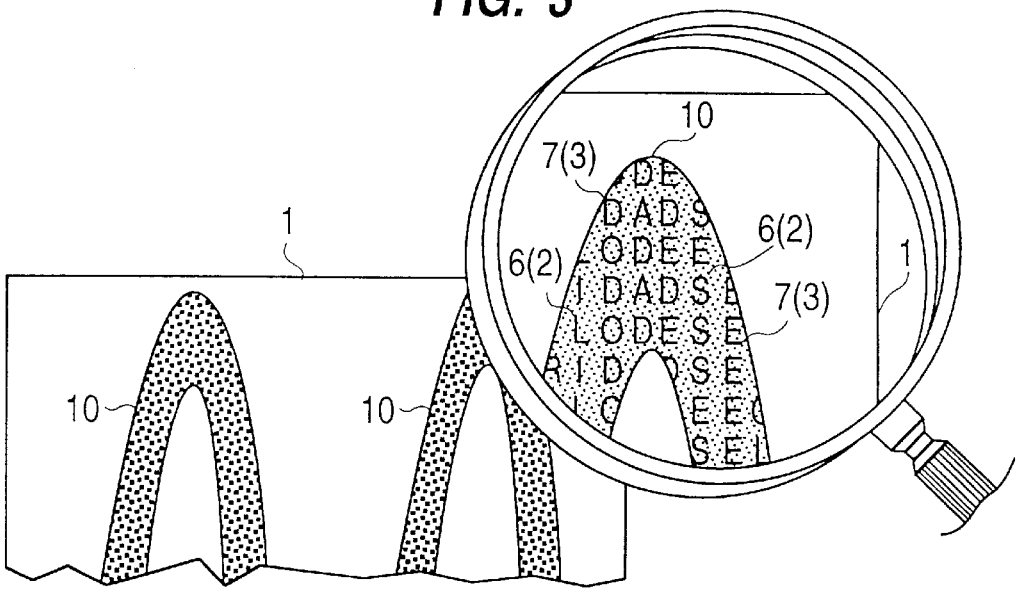

FIG. 3 corresponds to FIG. 1 showing a paper support as it would be seen at a glance, except for the scale which is enlarged in the same proportion as in FIG. 1.

Figure 4:
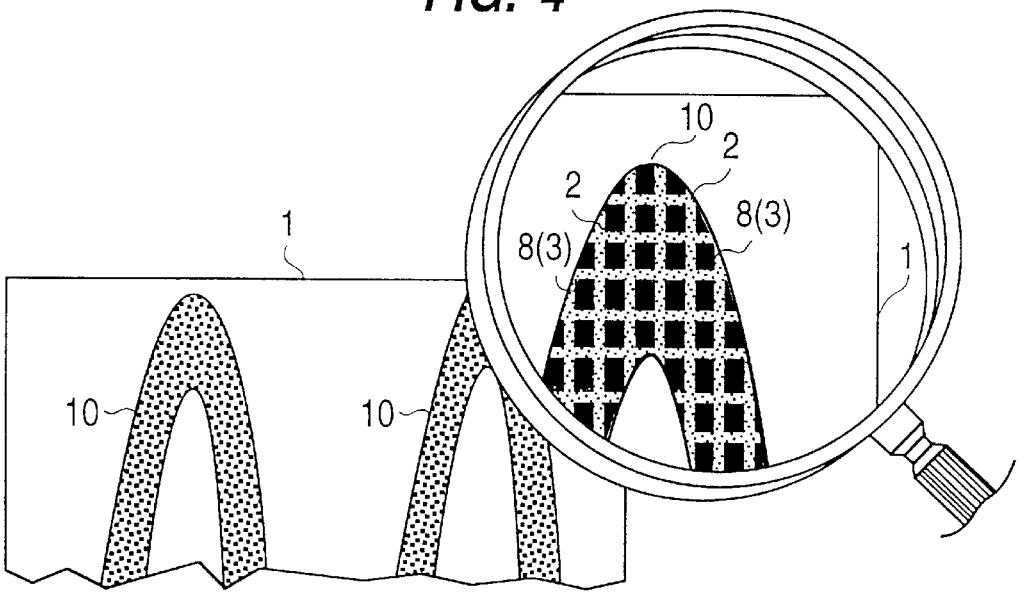

FIG. 4 shows a diagram of a copy of the document shown in FIG. 3 viewed in the same scale as FIGS. 1 and 3.

For further explanation of the present invention, it will be convenient to present the concepts of the figures and the background in a graphic pattern. The graphics (letters, drawings, or a combination of both) should be understood as a figure that has a perceptible meaning different from the background which will complement the surface where the figure or graphics are located. Despite the previous, this differentiation of figure and background does not always apply. There are certain designs, some simple and others complicated, where the background of a figure defines also a clearly distinguishable geometry. For example, if we consider a design of squares colored alternatively black and white, such as on a chess board, the differentiation of figure-background has no significance from the perceptive point of view. When we refer to a graphic pattern, we must understand that the same is made up of figures and backgrounds, wherein the assignation of the figure concept to certain areas is simply conventional.

In the example of the chess board, it will be equally valid to say that it is made up of an arrangement of rows and columns of black squares disposed in each row with a separation equivalent to a square and the columns of which are askew in the square; or the same could be said with reference to the white squares.

In this manner, a graphic pattern will generally be formed by the resultant between figures and background, without taking into consideration what types of areas the figure and the background are, with the condition that the assignation will not be inverted once the initial one has been defined.

Figure 2:
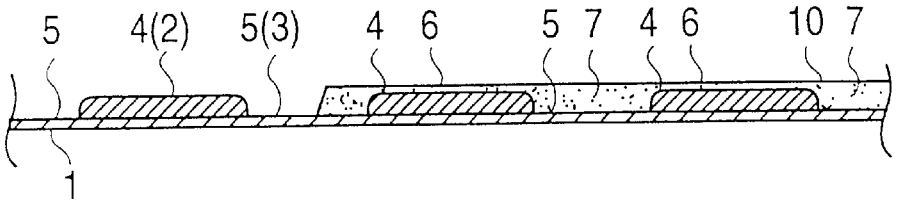
FIG. 2 shows a sectional view of the support of FIG. 1.

With respect to the invention, and according to what can be seen in FIGS. 1 and 2, a support 1, such as paper or the like, is imprinted with the backgrounds 2 of a micropattern of text or drawings by means of a non-absorbent ink such as an oil base ink and pigments of which produce a color substantially similar to the color of the support 1. Alternatively, the ink can have no pigment so that it will be transparent, leaving only an imprint on the background of the micropattern by means of its non-absorbent base.

The micropattern should be formed by an arrangement of FIGS. 3 (graphic elements or graphics) made up of graphic points, lines, or a combination of both, separated by distances smaller than the limit of resolution power of the copying machine. In the example described, the case of a negative micropattern is shown, that is, the area imprinted with the non-absorbent ink 4 coincides with the background 2, leaving holes or areas without imprint 5 in the corresponding regions of the FIGS. 3.

As an example of the limitation of the resolution power applied to the security support of the invention, it should be considered that the micropattern will not be reproducible by copying machine with a resolution of 600 dpi (dots per inch), which is equivalent to about 23.6 points per millimeter, that is, the distance between two neighboring elements in the same FIG. 3 should be less than 0.042 mm so as not to be recognizable by the copying machine, then two consecutive and parallel lines (or consecutive graphic points) of one of the FIGS. 3 should be separated by a distance of less than 0.042 mm. In this situation, a copier of 600 dpi will not be able to distinguish the lines as independent lines and will reproduce a blot instead of the lines which should be separated by distances of less than the critical distance.

In another variation of the invention, the area imprinted with the non-absorbent ink 4 can be of the positive type, that is, it can coincide with the FIGS. 3 of the micropattern, leaving the background 2 without impression, that is, the surface of the background is the surface of the support 1.

With the characteristics indicated in one of the variations of the invention (micropattern made up of figures formed by graphic lines or points separated by distance smaller than the critical distance for the resolution power of the copying machine; the background of the micropattern imprinted with a non-absorbent ink with or without pigments of a color substantially similar to the color of the support), a security support is obtained which can be seen at a glance as a paper or as an ordinary support. If one of these security supports is copied without any writing on it, the copy shall be a blank copy, that is, nothing special will be seen, not at a glance nor when inspected with optical instruments of enlargement, that is, the micropattern will not be present in latent state.

As seen in FIGS. 2 and 3, when one writes or prints on the security support containing the micropattern described, using a hydrophilous ink, such as water or alcohol based inks, for example, when signing a document with a fountain pen or a felt-tip marker, the ink invades the areas of the support (paper) 1 that are not pre-imprinted with the micropattern and it is absorbed by said support 1, leaving these areas impregnated by the ink (7). On the contrary, the areas where the writing has passed over the non-absorbent impression 4 are impermeable in such a manner that the superficial tension of these areas causes the hydrophilous ink to migrate rapidly from them, leaving a very thin layer 6 of this ink.

When just taking a glance at a document written on a support with the security micropattern of the invention, no special characteristics are distinguished (lower left area of FIG. 3, without enlargement), and an apparently ordinary support (paper, for example) is observed, with traces of hydrophilous ink 10 (text of the document, stamp, signature, drawings, etc.) and the density is apparently uniform.

If the original document realized on a support with the security micropattern of the invention is examined with an optical instrument for enlargement (a simple magnifier of 8× to 10×), a situation is detected such as the one illustrated in the upper right corner of FIG. 3 (area with magnifier) where the area of the support 1 which had not been imprinted or written on with hydrophilous ink maintains its ordinary look since the micropattern (in this case, the background) has been imprinted with an ink without pigment or with a pigment similar to the color of the support 1; and the area written or printed on with the strokes 10 which define the document (text of the document, stamp, signature, drawings, etc.) is now revealed as being integrated with the background tonality and graphic texture. Each stroke 10 is formed, on one hand, by a background with weak and uniform tonality corresponding to the areas 6 where the stroke of the hydrophilous ink (for example, alcohol based) is superposed on the non-absorbent microimpression 4. On the other hand, each stroke 10 is comprised of a graphic texture in those areas 7 where the hydrophilous ink, used for writing the document, had direct access to the material of the support 1 (non-absorbent ink-free areas 5), the hydrophilous ink impregnating these areas 5 completely. The latter is perceived as a darker texture than the tonality 6 of the background 2.

If a document, realized on the support containing a micropattern of the invention, is copied with a high-resolution instrument, the graphic elements or FIGS. 3 which are revealed in the strokes that define the document (areas 5) cannot be resolved (distinguished) in their detail by such copying instrument, so each one of these FIGS. 3 will be reproduced as a blot 8 (see FIG. 4). The halftones of the background or areas 6 of each stroke 10 can either be or be not reproduced as such, depending on the capability of halftone reproduction of the copying machine.

The possibility of falsifying documents executed on the security supports of the invention by using high-resolution color copying machines is practically non-existent since, even though the counterfeiter might possess the virgin supports containing the micropattern and these might be fed into copying machines, the copying machines will electrostatically deposit a thermofusible ink (toner) on the support or paper. In this case, the micropattern imprinted with non-absorbent ink is useless due to the fact that the intervention of the hydrophilous ink is not present, there is no fundamental interaction between these two types of ink that repel each other, which is the principle the invention is fundamentally based upon.

Several variations of the above described security support can exist that should be considered as integral part of the same.

One variation refers to the positive nature of the micropattern, that is, this micropattern can be formed starting with imprinting of the figure with non-absorbent ink, or the micropattern can be formed by imprinting of the background with non-absorbent ink—such as in the case of the variation described above.

Another variation is the nature of the support, which can be regular paper, currency paper, fabrics, etc.

Even a third variation of the invention can consist of defining a micropattern by means of printing with a hydrophilous ink (be it the figure or the background), in which case a non-absorbent ink with a low viscosity should be used for the strokes of the document.

The applications of the invention can be numerous, such as supports for manuscripts or printed documents printed with ink that repels the one in the latent micropattern; documents printed with ink with pigments of different color than the one of the support, but of the same nature as the latent micropattern (non-absorbent-non-absorbent or else hydrophilous-hydrophilous), in which case an examination with magnifier will show distinct differences, but if an identification stroke is made with ink of a nature that repels the one in the pattern, the stroke will reveal the presence or absence of the security support.

I claim:

1. A security support comprising:

a) a base support which can be imprinted; and b) a micropattern formed by a non-absorbent ink on said base support, said micropattern including an arrangement of figures on a background imprinted on said base support, each of the figures of the micropattern being smaller than a maximum resolution power of a high-resolution copying machine;

the security support with said micropattern being operative to receive imprinting of an image to be secured with hydrophilous ink, said figures of said micropattern being legible where the security support has been imprinted with said hydrophilous ink forming the image to be secured.

2. The security support according to claim 1, wherein said non-absorbent ink is one of an oil-based ink and a grease-based ink.

3. The security support according to claim 1, wherein said hydrophilous ink is an alcohol-based ink.

4. The security support according to claim 1, wherein the impression of the micropattern is of a positive type, wherein the ink which imprints the micropattern defines the figures that comprise such micropattern.

5. The security support according to claim 1, wherein the imprinting of the micropattern is of a negative type, wherein the ink which imprints the micropattern defines the background that comprises such micropattern.

6. The security support according to claim 1, wherein the distances between two adjacent lines or points that form each figure of the micropattern are smaller than 0.042 mm for preventing copying by copy machines with a maximum resolution of 600 dpi (dots per inch).

7. The security support according to claim 1, wherein the imprinting with said non-absorbent ink includes imprinting a document itself to be secured.

8. The security support according to claim 1, wherein each figure of the micropattern appears as anything but a blot when viewed with a magnification device, and, in a photocopy, each figure in the micropattern will appear as a blot.

9. A security support comprising:

a) a base support which can be imprinted;

b) a micropattern formed by hydrophilous ink, said micropattern including an arrangement of figures on a background imprinted on said base support, each of the figures of the micropattern being smaller than a maximum resolution power of a high-resolution copying machine;

the security support with said micropattern operable to receive imprinting of an image to be secured with a non-absorbent ink, said figures of said micropattern being legible where the security support has been imprinted with said non-absorbent ink forming the image to be secured.

10. The security support according to claim 9, wherein the imprinting with said hydrophilous ink includes imprinting a document itself to be secured.

11. The security support according to claim 9, wherein said non-absorbent ink is one of an oil-based ink and a grease-based ink.

12. The security support according to claim 9, wherein said hydrophilous ink is an alcohol-based ink.

13. The security support according to claims 9, wherein the impression of the micropattern is of a positive type, wherein the ink which imprints the micropattern defines the figures that comprise such micropattern.

14. The security support according to claim 9, wherein the imprinting of the micropattern is of a negative type, wherein the ink which imprints the micropattern defines the background that comprises such micropattern.

15. The security support according to claim 9, wherein the distances between two adjacent lines or points that form each figure of the micropattern are smaller than 0.042 mm for preventing copying by copy machines with a maximum resolution of 600 dpi (dots per inch).

16. The security support according to claim 9, wherein each figure of the micropattern appears as anything but a blot when viewed with a magnification device, and, in a photocopy, each figure in the micropattern will appear as a blot.

17. A method for preventing falsification of documents to be secured on a security support when a high-resolution copying machine is used comprising the steps of:

forming a micropattern using a non-absorbent ink on a base support, said micropattern including an arrangement of figures on a background covering said base support, each of the figures of the micropattern being made up of graphic points or lines separated by distances smaller than a limit of resolution power of the high-resolution copying machine; and creating a document to be secured using hydrophilous ink, said figures of said micropattern being legible where the security support has been imprinted with said hydrophilous ink forming said document to be secured.

18. The method according to claim 17, wherein each figure of the micropattern appears as anything but a blot when viewed with a magnification device, and, in a photocopy, each figure of the micropattern will appear as a blot.

19. A method for preventing falsification of documents to be secured on a security support when a high-resolution copying machine is used comprising the steps of:

forming a micropattern using hydrophilous ink on a base support, said micropattern including an arrangement of figures on a background covering said base support, each of the figures of the micropattern being made up of graphic points or lines separated by distances smaller than a limit of resolution power of the high-resolution copying machine; and creating a document to be secured using non-absorbing ink, said figures of said micropattern being legible where the security support has been imprinted with said hydrophilous ink forming said document to be secured.

20. The method according to claim 19, wherein each figure of the micropattern appears as anything but a blot when viewed with a magnification device, and, in a photocopy, each figure of the micropattern will appear as a blot.

* * * * *